US007011348B2

(12) United States Patent
Milo

(10) Patent No.: US 7,011,348 B2
(45) Date of Patent: Mar. 14, 2006

(54) ADJUSTABLE DOOR STRIKE PLATE AND ASSEMBLY

(75) Inventor: Thomas K. Milo, Akron, OH (US)

(73) Assignee: T.K.M. Unlimited, Inc., Akron, OH (US)

( * ) Notice: Subject to any disclaimer, the term of this patent is extended or adjusted under 35 U.S.C. 154(b) by 1 day.

(21) Appl. No.: 10/762,006

(22) Filed: Jan. 21, 2004

(65) Prior Publication Data

US 2005/0134061 A1 Jun. 23, 2005

Related U.S. Application Data

(60) Provisional application No. 60/532,012, filed on Dec. 22, 2003.

(51) Int. Cl.
*E05B 15/02* (2006.01)

(52) U.S. Cl. ..... 292/340; 292/341; 292/341.14; 292/341.15; 292/341.18; 292/341.19; 292/DIG. 39; 292/DIG. 40; 292/DIG. 60

(58) Field of Classification Search ..... 292/340, 292/341, 341.12, 341.13, 341.14, 341.15, 292/341.18, 341.19, DIG. 39, DIG. 40, DIG. 53, 292/DIG. 54, DIG. 60
See application file for complete search history.

(56) References Cited

U.S. PATENT DOCUMENTS 1,238,924 A * 9/1917 Kennedy ..... 292/341.19
1,612,225 A * 12/1926 Schoy ..... 292/341.18
1,793,115 A * 2/1931 Model ..... 292/341.18
2,013,145 A * 9/1935 Goetz ..... 292/341.18
2,231,414 A * 2/1941 Model ..... 292/341.18
2,403,182 A 7/1946 Leary et al.
2,695,807 A 11/1954 Bissot
2,781,219 A 2/1957 Bahorik
2,904,367 A 9/1959 Bennett et al.
3,449,006 A 6/1969 Petri
3,454,295 A 7/1969 Schlage et al.
3,586,361 A * 6/1971 Ohno ..... 292/169
3,966,248 A * 6/1976 James ..... 292/340
4,080,813 A 3/1978 McKann (Continued)

FOREIGN PATENT DOCUMENTS

GB 2230294 * 10/1990

OTHER PUBLICATIONS

Copy of Securitron brochure, copyright 2001.

*Primary Examiner*—Brian E. Glessner
*Assistant Examiner*—Carlos Lugo
(74) *Attorney, Agent, or Firm*—Fay, Sharpe, Fagan, Minnich & McKee, LLP

(57) ABSTRACT

An adjustable strike plate assembly includes a door strike housing and an insert plate. The door strike housing includes a strike plate having an opening and walls depending from the strike plate to define a cavity. The insert plate is adapted to mount to at least one of the walls and be received in the cavity to change the effective dimensions of the cavity.

24 Claims, 8 Drawing Sheets

U.S. PATENT DOCUMENTS

| | | | | | |
|---|---|---|---|---|---|
| 4,171,836 | A | | 10/1979 | St. Aubin | |
| 4,183,568 | A | * | 1/1980 | Ferracane | 292/341.18 |
| 4,213,317 | A | | 7/1980 | Ruff | |
| 4,218,084 | A | * | 8/1980 | Musacchia | 292/341.19 |
| 4,453,752 | A | | 6/1984 | McKann | |
| 4,492,397 | A | | 1/1985 | Allenbaugh | |
| 5,474,342 | A | | 12/1995 | Smith et al. | |
| 5,566,995 | A | | 10/1996 | Jagiela | |
| 5,613,718 | A | | 3/1997 | Lin | |
| 6,022,056 | A | | 2/2000 | Cope et al. | |
| 6,406,076 | B1 | | 6/2002 | Zarzycki, Jr. | |
| 6,471,265 | B1 | | 10/2002 | Scott, Sr. | |
| 6,581,991 | B1 | | 6/2003 | Galindo | |

* cited by examiner 10
36
34
18
16
16
16

ADJUSTABLE DOOR STRIKE PLATE AND ASSEMBLY

This application claims the priority benefit of U.S. Provisional Patent Application Ser. No. 60/532,012, which was filed on Dec. 22, 2003.

BACKGROUND OF THE INVENTION

The existing design of a standard commercial door strike plate is very basic. The outer dimensions of the door strike plate typically conform to applicable ANSI standards. Because of this standard, any commercial door strike plate should fit directly into any standard factory strike preparation cut out with no modifications required. Available door strike designs locate an open cavity, which is configured to accept a locking bolt and/or deadbolt of a corresponding door lock, anywhere on the strike plate. For the lock to work correctly, the location and size of the cavity and/or cavities of the door strike plate depends on the lock manufacturer's lock type and design (cylindrical or mortise) that the door strike plate receives and the variation in jamb depth to which the door strike plate mounts.

If the door lock hardware is not installed properly, as well as for other reasons, the locking bolt, latch and/or bolt of the door lock can hit the conventional door strike plate precluding the lock from actuating. Accordingly, it is desirable to provide a door strike plate that is adjustable to allow different locks to work with a single door strike plate assembly. Furthermore, it is desirable to provide a door strike plate assembly that can include multiple cavities to receive multiple latches, locking bolts and/or dead bolts.

SUMMARY OF THE INVENTION

A strike plate housing adapted to be received in a door jamb includes a strike plate and walls depending from the strike plate defining a housing cavity. The strike plate housing is adapted to receive at least one associated insert plate in the housing cavity to change the effective size of the housing cavity.

An adjustable strike plate assembly includes a strike plate having an opening and walls depending from the strike plate along a periphery of the opening defining a housing cavity. The assembly further includes means for selectively adjusting a first dimension of the housing cavity and means for selectively adjusting a second dimension of the housing cavity. The first dimension of the housing cavity is substantially perpendicular to the second dimension of the housing cavity.

An adjustable door strike assembly includes a door strike housing and an insert plate. The door strike housing includes a strike plate having an opening and at least two walls depending from the strike plate along the periphery of the opening to define a housing cavity. The insert plate is adapted to mount to at least one of the walls and be received in the housing cavity.

An adjustable strike plate assembly includes a housing defining a housing cavity. The housing is adapted to receive a first plurality of insert plates in the housing cavity in a first direction and a second plurality of insert plates in the housing cavity in a second direction substantially perpendicular to the first direction.

DETAILED DESCRIPTION OF THE INVENTION

Figure 1:
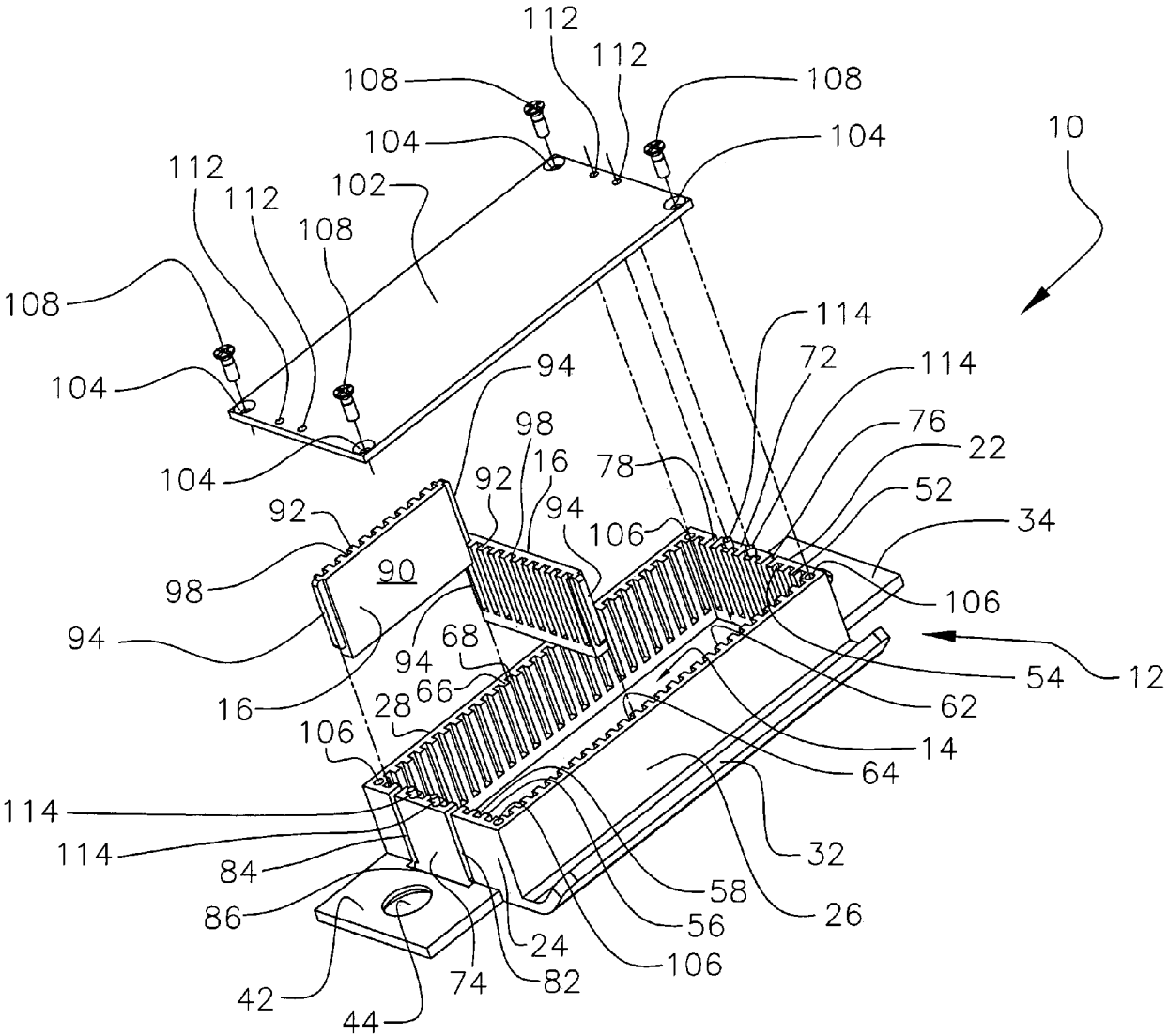
FIG. 1 is an exploded view of an adjustable strike plate assembly, showing only two insert plates.
Figure 5:
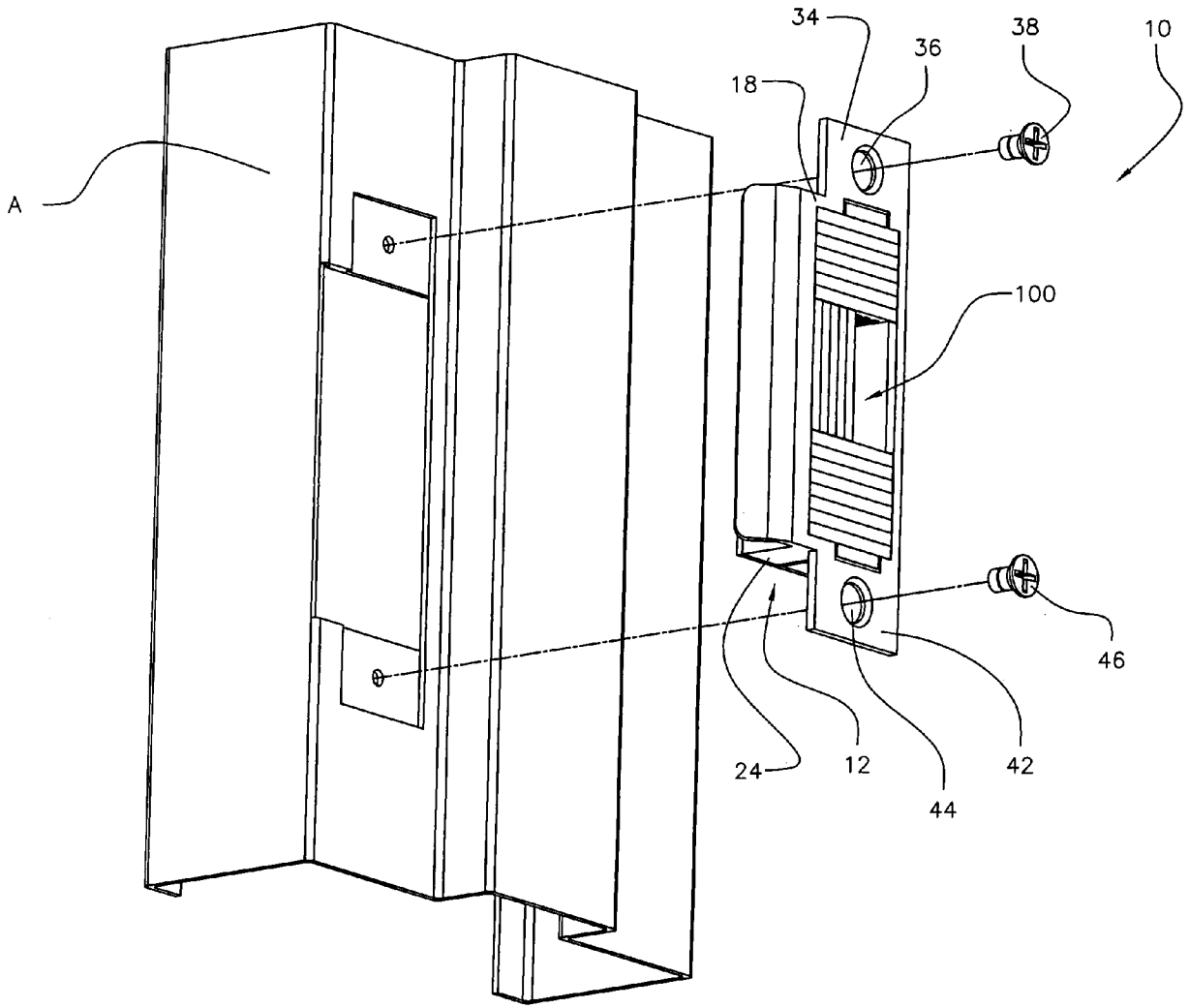
FIG. 5 is a perspective view of the strike plate assembly of FIG. 2 and an associated door jamb that receives the strike plate assembly.

Referring to FIG. 1, an adjustable door strike plate assembly 10 includes a housing 12 defining a housing cavity 14 and insert plates 16 disposed in the cavity to change the effective dimensions of the housing cavity. The housing 12 is preferably made of metal, but can be made of another suitable material. The housing can be formed from one piece or multiple pieces attached to one another. The dimensions of the housing allow the housing to fit into a standard factory preparation cut out in a door jamb A (FIG. 5). Such dimensions can conform to applicable ANSI standards. Preferably, the housing has a depth equal to the insert plate that it receives.

The housing 12 includes a strike plate 18 (FIG. 2) having a plurality of walls 22, 24, 26 and 28 depending substantially orthogonally from the strike plate. The strike plate 18 includes an opening to receive a latch, locking bolt and/or deadbolt of a door lock (not shown). The walls depend from the strike plate around the periphery of the opening. Lateral walls 22 and 24 define the top and bottom of the housing cavity 14, respectively. Longitudinal walls 26 and 28 define the longitudinal sides of the housing cavity 14. The term "cavity" is broadly used to describe an open space that accepts the latch, locking bolt and/or deadbolt of the door lock. Even though the cavity is depicted surrounded by the four walls 22, 24, 26 and 28, the cavity need not be defined on each side by a wall. The walls 22, 24, 26 and 28 depend from the strike plate 18 a dimension slightly less than the depth of a standard factory strike preparation cut out.

The strike plate 18 is similar to the strike plate of a conventional assembly; however, the strike plate can include a larger opening. A strike plate lip 32 extends from the strike plate 18 and cantilevers over the longitudinal wall 26. The strike plate lip 32 is curved similar to a conventional strike plate lip. A top mounting flange 34 extends from the strike plate 18 and cantilevers over the top lateral wall 22. The top mounting flange 34 includes an opening 36 (FIG. 2) that receives a conventional fastener 38 (FIGS. 5 and 7) to mount the housing 12 to the door jamb A. Similarly a bottom mounting flange 42 extends from the strike plate 18 and cantilevers over the bottom lateral wall 24. The bottom mounting flange 42 includes an opening 44 that receives a conventional fastener 46 (FIGS. 5 and 7) to mount the housing 12 to the door jamb A.

The walls 22, 24, 26 and 28 surround the periphery of the housing cavity 14 and are adapted to receive the insert plates 16 to reduce the effective size of the housing cavity 14. The top lateral wall 22 includes a plurality of protrusions or tabs 52 that extend from the wall 22 toward the cavity. The tabs 52 define notches or grooves 54. Similarly the bottom lateral wall 24 includes a plurality of protrusions or tabs 56 that extend from the wall 24 toward the housing cavity 14. The tabs 56 define notches or grooves 58. The top grooves 54 align with the bottom grooves 58 and the top tabs 52 align with the bottom tabs 56. In the preferred embodiment, the grooves 54 and 58 and the tabs 52 and 56 are evenly spaced from one another.

The longitudinal wall 26 includes a plurality of protrusions or tabs 62 that extend from the wall 26 toward the housing cavity 14. The tabs 62 define notches or grooves 64. Similarly the longitudinal wall 28 includes a plurality of protrusions or tabs 66 that extend from the wall 28 toward the housing cavity 14. The tabs 66 define notches or grooves 68. Similar to the grooves 54 and 58 described above, in the preferred embodiment, the grooves 64 and 68 are aligned with one another and each are evenly spaced from one another.

Preferably, each of the grooves 54, 58, 64 and 68 terminates approximately ⅛" from the strike plate 18. In the preferred embodiment, the tabs and the grooves are ⅛" square in cross-section; however, the tabs and grooves can also be dove-tailed, for example, or another configuration. In the preferred embodiment, the grooves are formed by removing a portion of each wall to create the tabs.

The housing also includes a pair of breakaway tabs 72 and 74 that are selectively removable from the housing 12. The top breakaway tab 72 is separated by a pair of cut-outs 76 and 78 in the top lateral wall 22 on each side of the breakaway tab. Similarly, the bottom breakaway tab 74 is separated by a pair of cut-outs 82 and 84 on each side of the breakaway tab. The cut-outs 76, 78, 82 and 84 have the same cross-sectional width as the grooves in the walls to allow the cut-outs to receive a portion of the insert plates 16, which will be described in more detail below.

The bottom breakaway tab 74 extends outwardly from the bottom wall 24 toward the bottom mounting flange 42. A notch 86 is disposed in the lower surface of the bottom mounting flange 42 and connects with each cut-out 82 and 84. The notch 86 extends into the bottom mounting flange 42 about one-half its thickness as more clearly seen in FIG. 4. The notch 86 acts as a sort of score line. A similar notch 88 (FIG. 3) is disposed in the lower surface of the top mounting flange 34.

Figure 6:
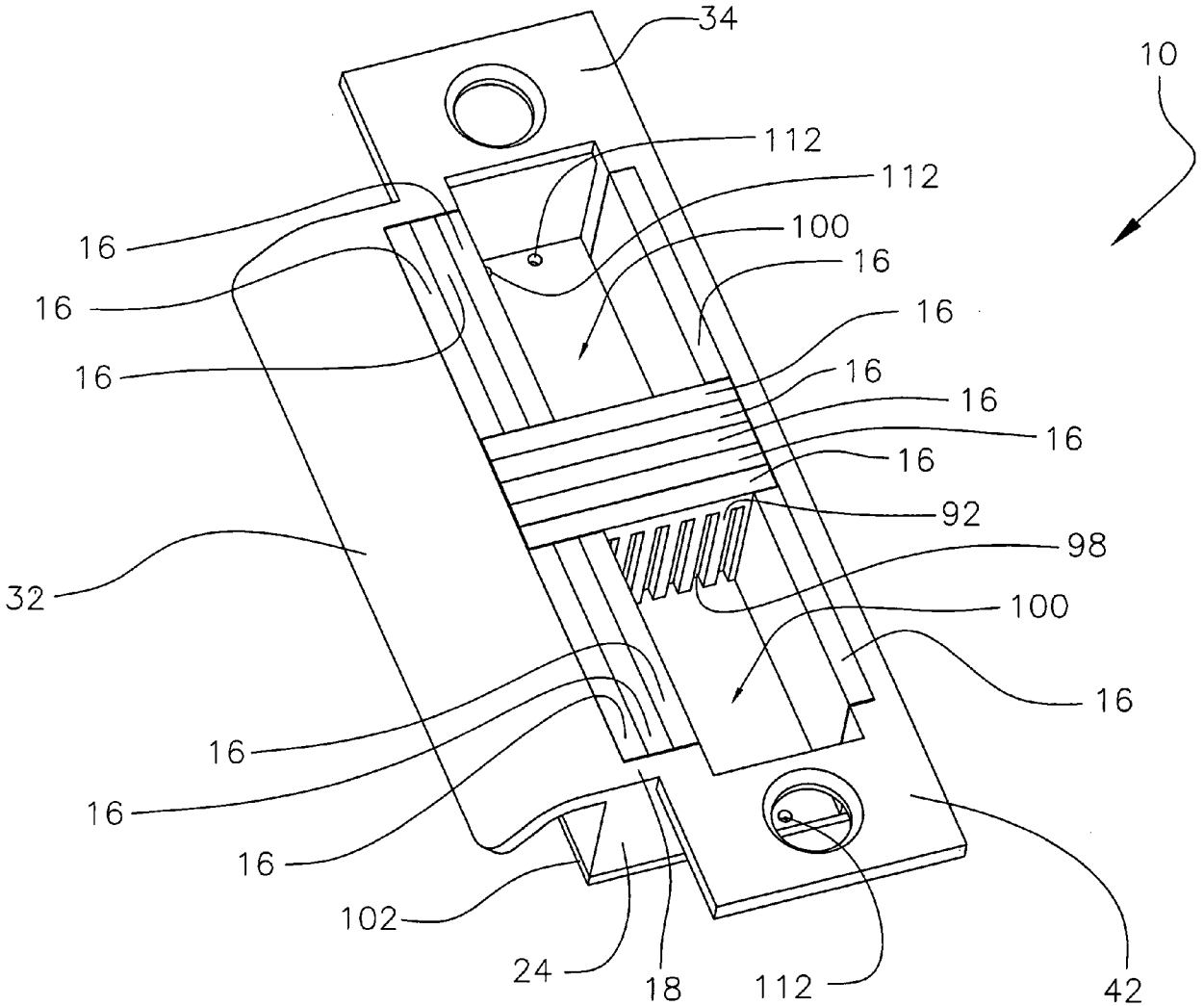
FIG. 6 is a perspective view of the strike plate assembly of FIG. 1 assembled to have two latch cavities and having breakaway tabs removed from the housing.
Figure 7:
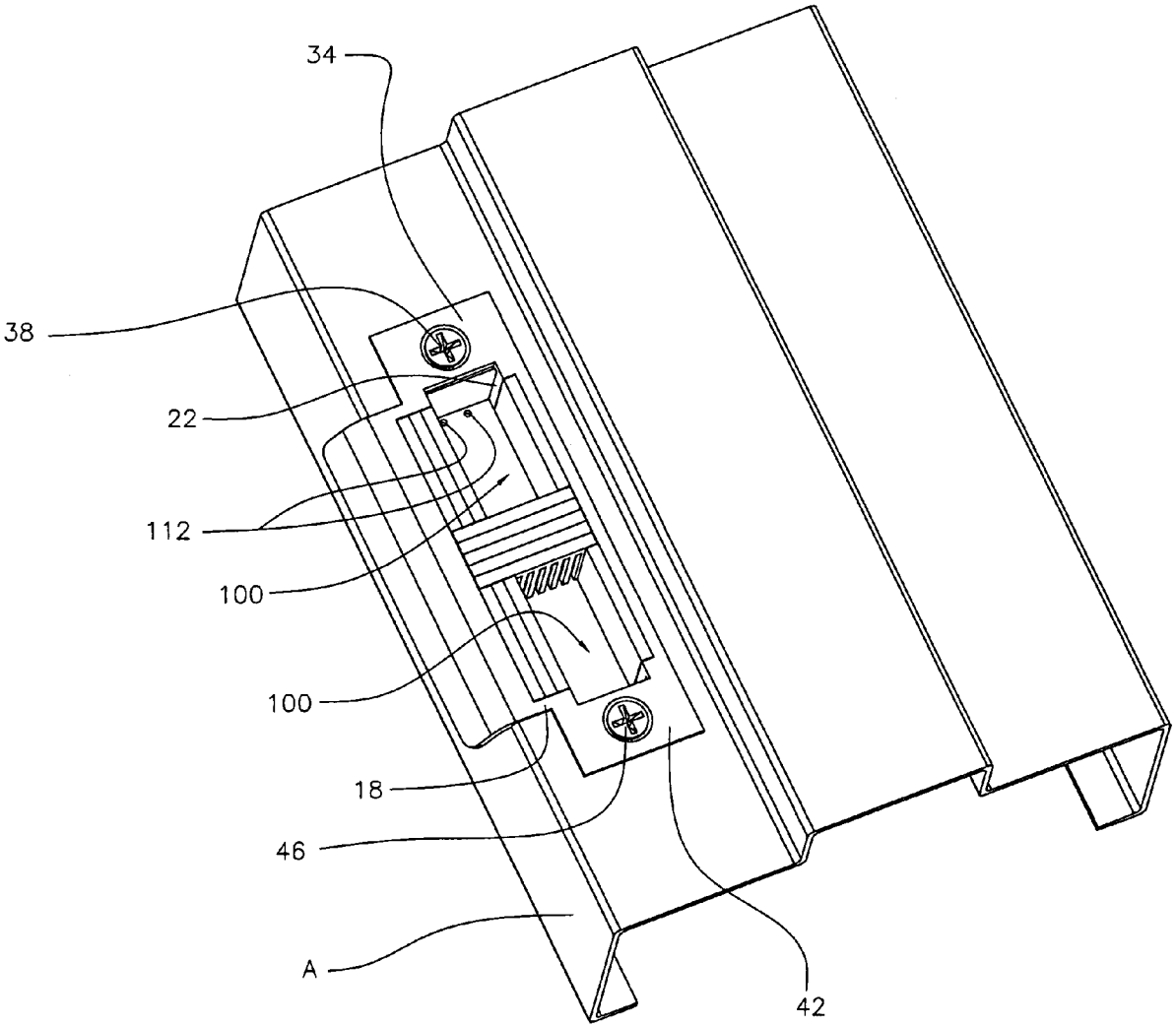
FIG. 7 is a perspective view of the strike plate assembly of FIG. 6 received in the associated door jamb.

Each tab 72 and 74 can be selectively removed from the housing 12 by bending the tab inward toward the housing cavity 14. The breakaway tabs can be removed from the housing if the installer needs additional room at the bottom and/or top of the door strike plate assembly in cases where the existing door lock hardware is installed and the lock's latch and/or bolt hits the top and/or bottom of the assembly. The breakaway tabs removed from the housing are depicted in FIGS. 6 and 7. In the preferred embodiment, each breakaway tab when broken off can provide an extra ⅛" of housing cavity 14 and with the tabs removed, the cavity top and/or bottom is aligned flush with the standard factory strike preparation cut out. The preferred design provides two breakaway tabs; however, multiple breakaway tabs can be provided in alternative embodiments.

The insert plates 16 are received in the grooves 54, 58, 64 and 68 of the walls 22, 24, 26 and 28. The insert plates can also be received in the cut outs 76, 78, 82 and 84. Each plate includes a front surface 90, a plurality of rear tabs 92 extending from a rear surface and a pair of side tabs 94. The front surface 90 in the embodiment depicted is flat and parallel to the rear surface. In a preferred embodiment, all of the insert plates 16 are identical in size and shape; however, the insert plates could vary in length and width if desired. The insert plates preferably are made of metal; however, other suitable materials can be used.

The plurality of rear tabs 92 extend perpendicularly or substantially perpendicularly from the rear surface and define a plurality of slots 98. Preferably, the slots 98 of the insert plates are the same dimension as the grooves 54, 58, 64 and 68 in the walls. The slots are evenly spaced ⅛" from one another and also terminate approximately ⅛" from the strike end, the end of the insert plate that faces the strike plate 18 when the insert plate is inserted into the housing cavity 14.

The side tabs 94 of the insert plate are dimensioned to fit into both the slots 98 of another insert plate and the grooves 54, 58, 64 and 68 in the walls as seen in FIG. 1. Also, the side tabs can fit into the cut outs 76, 78, 82 and 84. The side tabs 94 extend from opposite sides of the insert plate parallel with and offset from the front surface 90 and the rear surface. The side tabs 94 are offset from the strike end of the insert plate 90, preferably ⅛". Accordingly, when the insert plate 16 is inserted into the housing, the strike end of the insert plate sits flush with the face plate 18 of the housing.

The insert plates 16 can be received in the housing cavity 14 to form a zero cavity (a blank), a single latch cavity 100 (FIG. 2), which is smaller than the housing cavity 14, or a multiple cavity 100 (FIG. 4) design. In the preferred embodiment, since the notches and slots are equally spaced ⅛" apart from one another, a latch cavity or cavities 100 can be located horizontally and/or vertically anywhere in the housing cavity 14 in ⅛" increments. Also, the spacing can be different if different spacing is used for the grooves 54, 58, 64 and 68.

Figure 2:
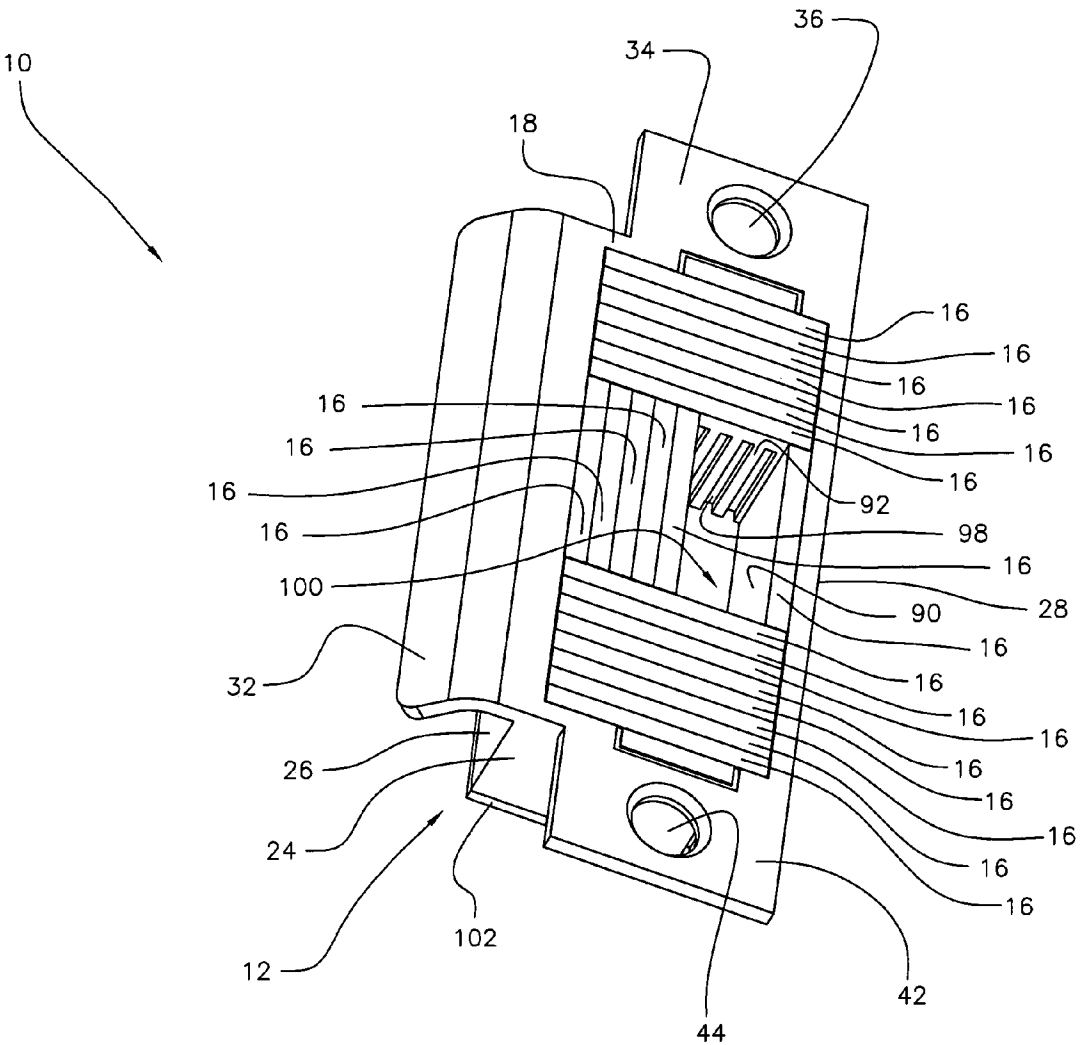
FIG. 2 is a front perspective view of the strike plate assembly of FIG. 1 assembled to have one latch cavity.
Figure 3:
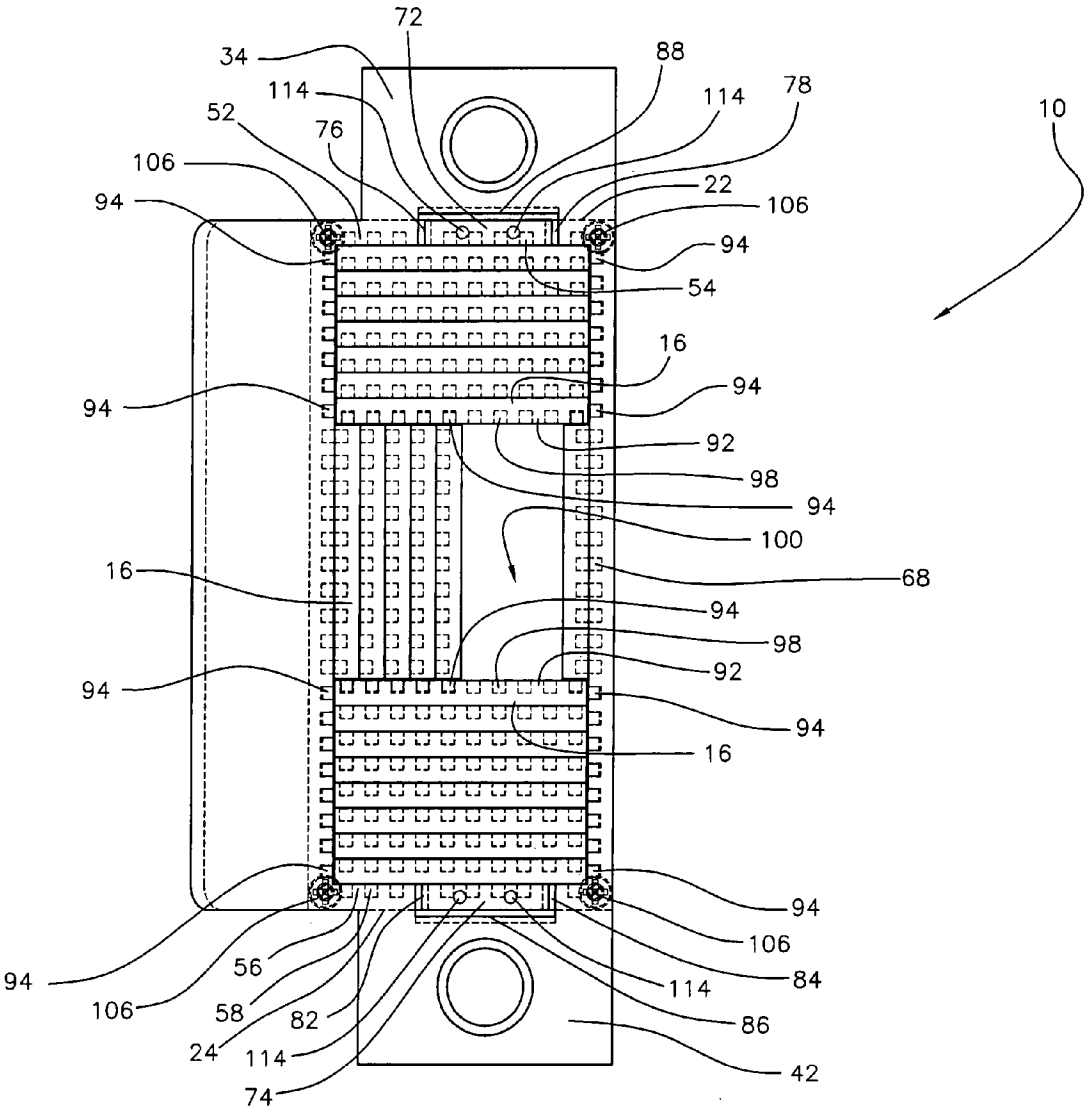
FIG. 3 is a front elevation view of the assembled strike plate assembly shown in FIG. 2 (with internal features being represented by dashed lines).
Figure 4:
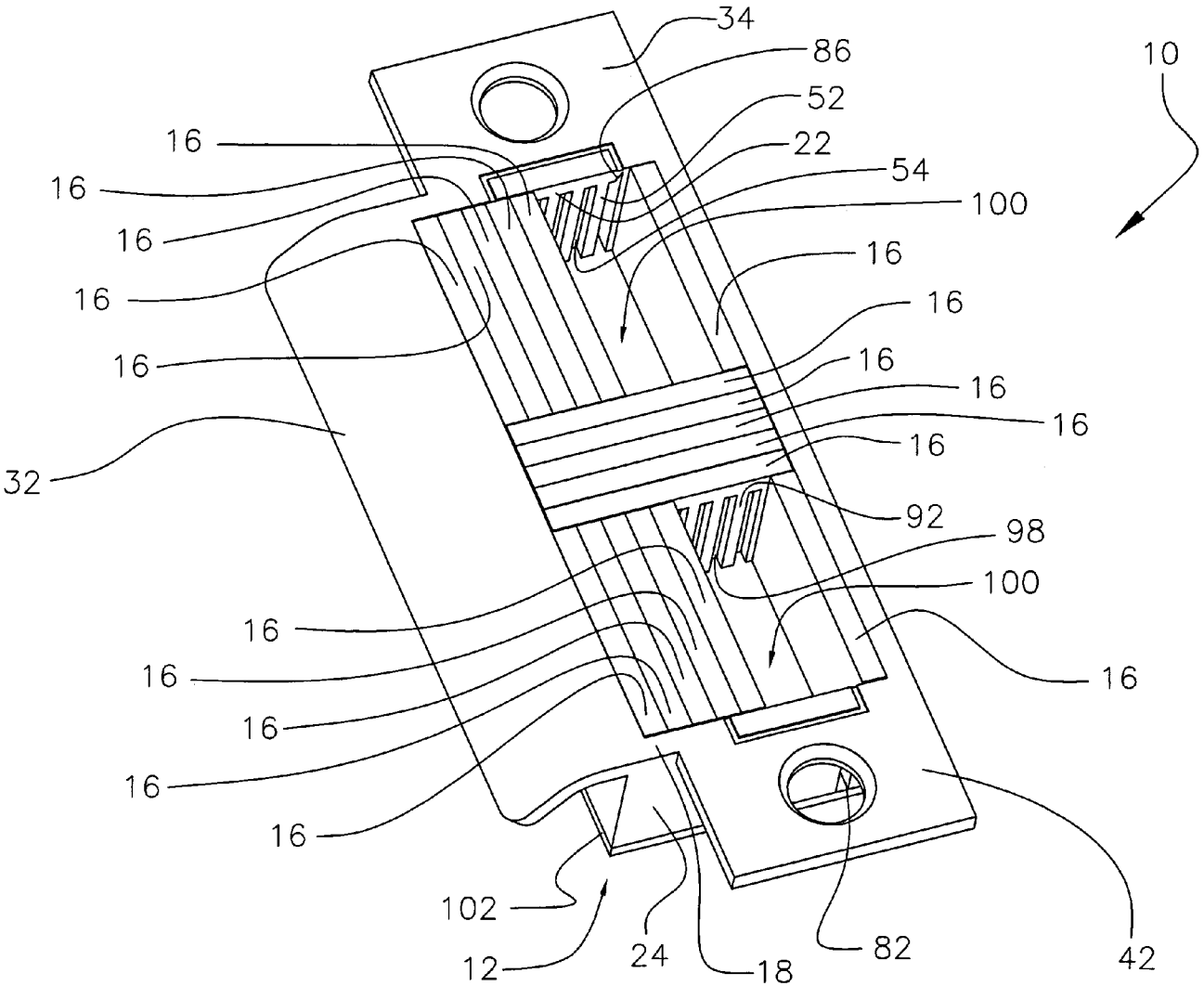
FIG. 4 is a perspective view of the strike plate assembly of FIG. 1 assembled to have two latch cavities.

With reference to FIG. 3, the insert plates 16 can be received in the housing cavity 14 in either a longitudinal or lateral direction. As seen in FIG. 2, the insert plates can be positioned to provide one cavity 100. Alternatively, as seen in FIG. 4 two cavities 100 can be provided. Also, with reference to FIG. 6, the breakaway tabs 72 and 74 can be removed from the housing 12 to provide more room to the top and/or bottom of the cavity 14. In the embodiments depicted, one insert plate can be positioned in the cavity substantially perpendicular to another insert plate, as most clearly seen in FIG. 1.

To further retain the insert plates 16 inside the housing cavity 14, a rear panel 102 is provided. With the insert plates received in the housing cavity, the rear panel 102 can fix the insert plates 16 between the rear panel and the strike face 18. Since the grooves 54, 58, 64 and 68 of the walls 22, 24, 26 and 28, the slots 98 of the insert plates 16 and the side tabs 94 of the insert plates are offset, the strike end of the insert plate sits flush with the strike face 18. The rear panel 102 mounts to the housing 12 to close off the housing cavity 14 at the rear of the housing. In the embodiment depicted, the rear panel 102 is shown as a substantially solid plate; however, the rear panel can include an opening or a plurality of openings. In one particular alternative, the rear panel can include a large rectangular opening, for example, simply surround the periphery of the housing cavity 14. In another alternative embodiment, the insert plates need not connect to the side wall and/or each other and it can be the rear panel cooperating with the strike plate that retains the insert plates in a fixed location.

In the embodiment depicted in the figures, the rear panel includes four openings 104 at the corners of the rear panel. The panel openings 104 align with openings 106 located at the intersection of the walls 22, 24, 26 and 28. The aligned openings 104 and 106 receive conventional fasteners 108 to attach the rear panel to the housing 12. Alternatively, the rear panel 102 can attach to the housing 12 in any conventional manner.

The rear panel 102 also includes openings 112 that receive pins 114 extending upwardly from the breakaway tabs 72 and 74. The pins 114 are received in the openings 112 to support the breakaway tabs to prevent accidental breakage of the breakaway tabs.

Figure 8:
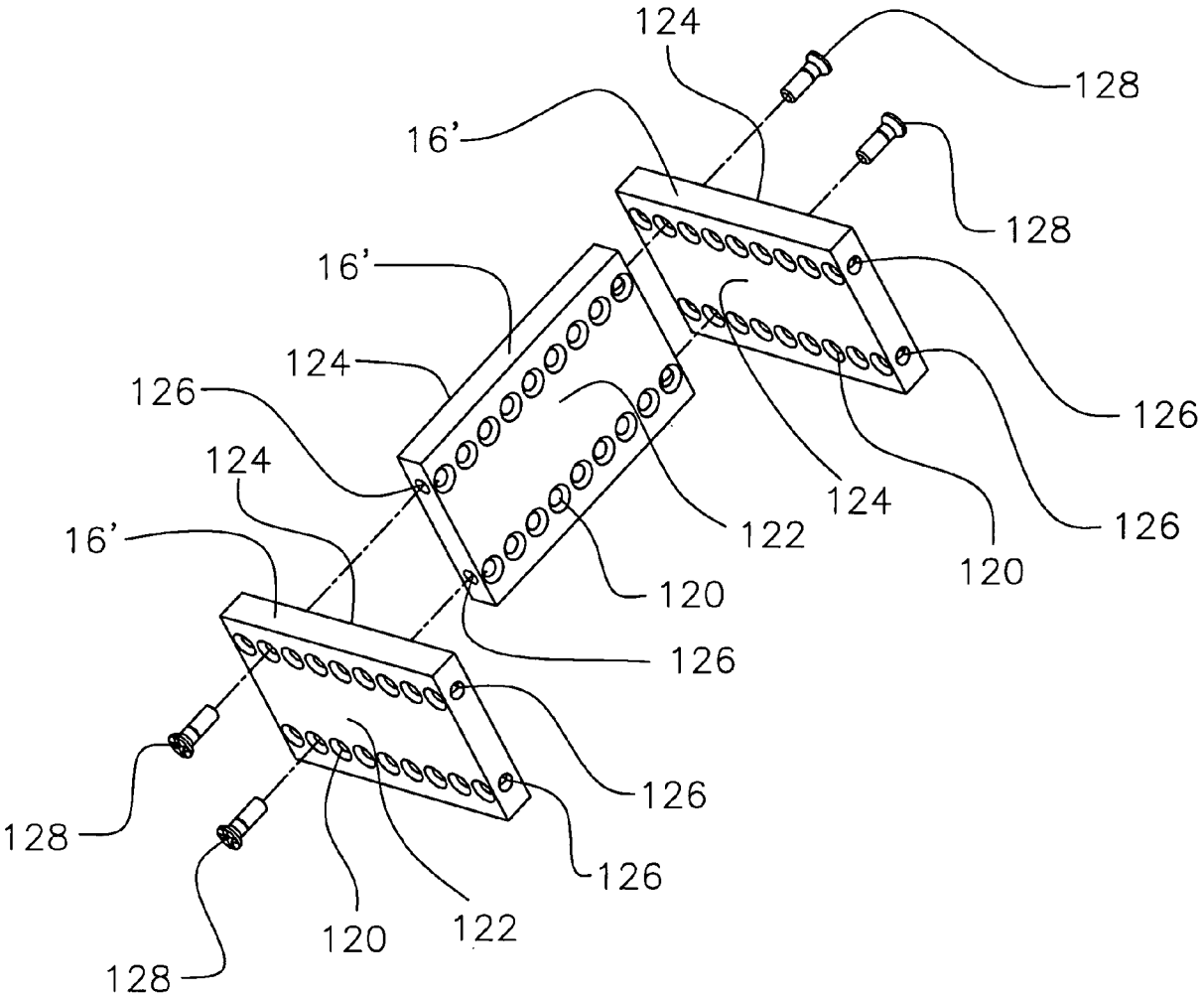
FIG. 8 is an alternative embodiment of the insert plates.

The adjustable door strike plate assembly 10 has been described as including strike plate inserts 16 that include tabs 94 that can be received into grooves 54, 58, 64 and 68 of the walls 22, 24, 26 and 28; however, the size of the housing cavity 14 can change using other methods. As just one example, with reference to FIG. 8, an alternative insert 16' can include a plurality of openings 120 that extend from a first or front surface 122 through the insert 16' to a second or rear surface 124. The openings 120 can be evenly spaced from one another with a first row of openings 120 located in an upper portion of the insert 16' and a second row of openings 120 located in a lower portion of the insert. The inserts 16' can also include end openings 126 located on each end of the insert. The openings 120 and 126 can receive fasteners 128 to attach the inserts 16' to one another. The walls of the housing can also include openings so that the inserts 16' can attach to the housing. FIG. 8 discloses only one non-limiting alternative of a multitude of conventional methods in which the size of the housing cavity 14 can be changed. Another non-limiting example, would be to sandwich the insert plates 16 between the rear panel 102 and the strike plate 18. In this embodiment, the rear panel could include notches or other elements into which the insert plates could fit, or the rear panel could be smooth.

The terms "top," "bottom," "front," and "rear" have been used to more easily describe the figures. For example, the rear panel was described as being selectively removable from the housing; however, any of the side walls or even the strike plate can provide access to the housing cavity to allow the insert plates to be disposed in the housing. Accordingly, these terms should not be deemed as limiting the invention to only those configurations described. Furthermore, the adjustable strike plate assembly has been described with reference to preferred embodiments, obviously modifications and alterations will occur to others upon reading and understanding the preceding detailed description. This description should not be found as limiting, it is intended that the invention be construed as including all such modifications and alterations insofar as to come within the scope of the appended claims or the equivalents thereof.

What is claimed is:

1. A strike plate housing adapted to be received in a door jamb, said strike plate housing comprising a strike plate, a first wall and a second wall, said first and second walls depending from the strike plate and defining a housing cavity, wherein said strike plate housing is adapted to selectively receive at least one associated insert plate in the housing cavity such that the at least one insert plate is at least substantially fixed in said housing, and wherein said first wall includes a first plurality of grooves along the first wall on a first side of the housing cavity, wherein at least one groove of the first plurality of grooves is adapted to receive at least a portion of the at least one associated insert plate, and wherein said second wall includes a second plurality of grooves along the second wall on a second side of the cavity opposite the first side of the cavity wherein at least one groove of the second plurality of grooves is adapted to receive at least a portion of the at least one associated insert plate.

2. The strike plate housing of claim 1, wherein the grooves making up the first plurality of grooves are substantially equally spaced from one another.

3. The strike plate housing of claim 1, wherein at least one groove of the first plurality of grooves terminates spaced from the strike plate.

4. The strike plate housing of claim 1, further comprising a breakaway tab selectively removable from one of the walls.

5. The strike plate housing of claim 4, further comprising a mounting flange having an opening adapted to receive a fastener to mount said adjustable strike plate housing to an associated door jamb, wherein the breakaway tab is selectively removable from the mounting flange.

6. The strike plate housing of claim 1 wherein said housing cavity comprises a depth substantially equal to the height of the associated insert plate that said strike plate housing is adapted to receive.

7. The strike plate housing of claim 1, further comprising a panel selectively attached to at least one of said walls depending from the strike plate, wherein said panel is spaced from the strike plate such that said panel retains a surface of the at least one associated insert plate substantially flush with the strike surface.

8. The strike plate housing of claim 7, further comprising a breakaway tab selectively removable from one of the walls, the breakaway tab including a pin, the panel including a pin opening, wherein the pin is selectively received in the pin opening.

9. The strike plate housing of claim 1, further comprising a panel mounted to at least one of the walls of the depending from the strike plate, wherein said panel at least substantially encloses the housing cavity on one side and is spaced from said strike plate a distance substantially equal to the height of the associated insert plate that said strike plate housing is adapted to receive.

10. The assembly of claim 1, wherein the second plurality of grooves align with the first plurality of grooves.

11. An adjustable strike plate assembly comprising:

a strike plate having an opening;

walls depending from said strike plate along a periphery of the opening defining a housing cavity;

a first insert plate received in the housing cavity and selectively mounted to one of said walls;

a second insert plate received in the housing cavity and adapted to selectively mount to at least one of the walls and be selectively received by said first insert plate.

12. The assembly of claim 11, wherein the first insert plate is received in the housing cavity to adjust a first dimension of the housing cavity.

13. The assembly of claim 12, wherein the second insert plate is received in the housing to adjust a second dimension of the housing cavity, wherein the first dimension is at least substantially perpendicular to the second dimension.

14. An adjustable door strike assembly comprising: a door strike housing including a strike plate having an opening and at least two walls depending from the strike plate along the periphery of the opening; and a first insert plate adapted to mount to one of the at least two walls; and a second insert plate adapted to be attach to said first insert plate, wherein each of said walls is adapted to allow said first insert plate to mount to said wall in at least two predetermined locations along each of said walls; wherein at least one of said insert plates includes a first surface and a second surface spaced from and substantially parallel with the first surface, said at least one insert plate further including a plurality of tabs extending from and substantially normal to the second surface.

15. The assembly of claim 14, wherein said first insert plate includes an end tab extending from an end of said first insert plate substantially parallel to and offset from the first surface.

16. The assembly of claim 14, wherein said first insert plate includes a strike end that faces the strike plate when said first insert plate is inserted into the cavity.

17. The assembly of claim 14, wherein said first insert plate includes a tab extending from and substantially parallel with the first surface.

18. The assembly of claim 14, wherein said second insert plate has substantially the same dimensions as said first insert plate.

19. The assembly of claim 18, wherein said first insert plate is adapted to be mount at least substantially perpendicular to said second insert plate.

20. An adjustable strike plate assembly comprising:

a strike plate housing comprising a strike plate, a first wall extending from the strike plate, and a second wall extending from the strike plate and the first wall, the first wall including a first plurality of grooves and the second wall including a second plurality of grooves; and a first insert plate selectively received in at least one of the first plurality of grooves.

21. The assembly of claim 20, further comprising a second insert plate selectively received in at least one of the second plurality of grooves such that the first plate is at least substantially perpendicular to the second plate.

22. An adjustable strike plate assembly comprising:

a strike plate housing comprising a strike plate, a first wall extending from the strike plate, and a second wall extending from the strike plate, the second wall being spaced from and at least substantially parallel to the first wall, the first wall including a first plurality of mounting locations and the second wall including a second plurality of mounting locations;

a first insert plate selectively mounted to the first wall at one of the first plurality of mounting locations and mounted to the second wall at one of the second plurality of mounting locations, the first insert plate extending between the first wall and the second wall.

23. The assembly of claim 22, wherein the first insert plate is disposed at least substantially perpendicular to the first wall and the second wall.

24. The assembly of claim 22, further comprising a second insert plate contacting the first insert plate.

* * * * *